US009347297B2

(12) United States Patent
Li et al.

(10) Patent No.: US 9,347,297 B2
(45) Date of Patent: May 24, 2016

(54) DOWNHOLE CASING EXPANSION TOOL AND METHOD OF EXPANDING CASINGS USING THE SAME

(71) Applicants: China Petroleum & Chemical Corporation, Beijing (CN); Drilling Technology Research Institute of Sinopec Oilfield Service Shengli Corporation, Dongying (CN)

(72) Inventors: Zuohui Li, Dongying (CN); Ming Tang, Dongying (CN); Liugen Wu, Dongying (CN); Jianzhong Ma, Dongying (CN); Peng Cai, Dongying (CN); Zhigang Peng, Dongying (CN); Wansheng Zhu, Dongying (CN); Chenglei Tang, Dongying (CN); Zhaozheng Teng, Dongying (CN); Xuetao Ning, Dongying (CN); Haibo Zhu, Dongying (CN); Xuexiang Shen, Dongying (CN)

(73) Assignees: CHINA PETROLEUM & CHEMICAL CORPORATION, Beijing (CN); DRILLING TECHNOLOGY RESEARCH INSTITUTE OF SINOPEC OILFIELD SERVICE SHENGLI CORPORATION, Dongying (CN)

( * ) Notice: Subject to any disclaimer, the term of this patent is extended or adjusted under 35 U.S.C. 154(b) by 364 days.

(21) Appl. No.: 14/057,819

(22) Filed: Oct. 18, 2013

(65) Prior Publication Data

US 2014/0110136 A1 Apr. 24, 2014

(30) Foreign Application Priority Data

Oct. 18, 2012 (CN) ..... 2012 1 0395893

(51) Int. Cl.
*E21B 43/10* (2006.01)

(52) U.S. Cl.
CPC ..... *E21B 43/105* (2013.01); *E21B 43/103* (2013.01)

(58) Field of Classification Search
CPC ... E21B 43/105; E21B 43/103; E21B 43/106; E21B 23/04; E21B 29/10; E21B 33/047; E21B 43/108; E21B 23/00; E21B 23/01
See application file for complete search history.

(56) References Cited

U.S. PATENT DOCUMENTS 7,028,770 B2 * 4/2006 Smith, Jr. ..... E21B 43/105 166/206
7,117,940 B2 * 10/2006 Campo ..... E21B 21/103 166/206

(Continued)

FOREIGN PATENT DOCUMENTS

CN 101285375 A 10/2008
CN 201567994 U 9/2010

(Continued)

OTHER PUBLICATIONS

Search Report dated Apr. 27, 2015, issued by the Chinese Patent Office in the corresponding Chinese Patent Application No. 2013104885480. (2 pages).

(Continued)

*Primary Examiner* — Daniel P Stephenson
(74) *Attorney, Agent, or Firm* — Buchanan Ingersoll & Rooney PC

(57) ABSTRACT

A downhole casing expansion tool and a method of expanding casings using the same. The expansion tool includes an expansion module for expanding casings and a drive module for driving the expansion module. The diameter of the open-hole can be kept consistent by the expansion tool, so that monohole well drilling and completion operations can be carried out. The expansion tool is particularly suitable for constructions in deep, ultra-deep and complex wells.

22 Claims, 15 Drawing Sheets

(56) References Cited

U.S. PATENT DOCUMENTS

| | | | | |
|---|---|---|---|---|
| 7,886,831 | B2 * | 2/2011 | Butterfield, Jr. | E21B 43/105 166/177.4 |
| 8,286,717 | B2 * | 10/2012 | Giroux | E21B 47/122 166/208 |
| 8,397,826 | B2 * | 3/2013 | O'Connor | E21B 43/103 166/207 |
| 2002/0060078 | A1 * | 5/2002 | Cook | B21D 39/203 166/380 |
| 2003/0075339 | A1 * | 4/2003 | Gano | E21B 43/105 166/380 |
| 2003/0116325 | A1 * | 6/2003 | Cook | E21B 17/1042 166/382 |
| 2004/0163823 | A1 * | 8/2004 | Trinder | E21B 43/105 166/382 |
| 2005/0045341 | A1 * | 3/2005 | Cook | B21D 39/04 166/380 |
| 2005/0269107 | A1 * | 12/2005 | Cook | E21B 43/106 166/384 |
| 2006/0207760 | A1 * | 9/2006 | Watson | E21B 33/126 166/207 |
| 2007/0221374 | A1 * | 9/2007 | Filippov | E21B 43/103 166/207 |
| 2009/0032266 | A1 * | 2/2009 | Farquhar | E21B 43/106 166/384 |
| 2009/0107686 | A1 * | 4/2009 | Watson | E21B 43/105 166/381 |
| 2009/0229835 | A1 * | 9/2009 | Filippov | E21B 43/105 166/380 |
| 2010/0032169 | A1 * | 2/2010 | Adam | E21B 43/105 166/382 |
| 2012/0085549 | A1 * | 4/2012 | O'Connor | E21B 43/105 166/380 |
| 2013/0228344 | A1 * | 9/2013 | Luke | E21B 33/14 166/382 |
| 2013/0333875 | A1 * | 12/2013 | Hiorth | E21B 33/1208 166/179 |
| 2014/0054047 | A1 * | 2/2014 | Zhou | E21B 43/106 166/382 |
| 2014/0054048 | A1 * | 2/2014 | Schneidmiller | E21B 33/1208 166/387 |
| 2014/0110136 | A1 * | 4/2014 | Li | E21B 43/103 166/382 |

FOREIGN PATENT DOCUMENTS

| | | | |
|---|---|---|---|
| CN | 101906974 | A | 12/2010 |
| CN | 101915059 | A | 12/2010 |
| CN | 202300266 | U | 7/2012 |
| WO | 02/29199 | A1 | 4/2002 |

OTHER PUBLICATIONS

Search Report dated Sep. 6, 2015, issued by the Chinese Patent Office in the corresponding Chinese Patent Application No. 2013104884543. (2 pages).

* cited by examiner

DOWNHOLE CASING EXPANSION TOOL AND METHOD OF EXPANDING CASINGS USING THE SAME

TECHNICAL FIELD

The present disclosure relates to a drilling and completion tool, particularly to a downhole casing expansion tool. The present disclosure further relates to a method of expanding casings using the same.

TECHNICAL BACKGROUND

In conventional oil and gas filed well drilling operations, it requires putting casings downhole to realize stratum blocking in order to ensure safety and favorable arrival in the target layer. In a wellbore casing structure sequence, as the number of casing layers in the well increases, the casing size and the borehole size are progressively reduced, and the borehole taper is progressively increased, so that the target depth cannot be reached in deep, ultra-deep and complex wells or the subsequent operations will be affected by too small sizes of boreholes.

Therefore, it requires to improve wellbore structures and drilling and completion techniques to ensure a constant borehole size and completion inner diameter and thus to drill deeper wells.

SUMMARY OF THE INVENTION

To solve the above technical problems in the prior art, the present disclosure discloses a downhole casing expansion tool, which can maintain a constant borehole size in the drilling operations and therefore is particularly suitable for the constructions of deep, ultra-deep and complex wells. The present disclosure further relates to a method of expanding casings using the same.

According to a first aspect of the present disclosure, it discloses a downhole casing expansion tool comprising an expansion module for expanding a casing and a drive module for driving the expansion module to expand.

The drive module comprises a central tube, a core tube and an outer tube successively arranged from the inside to the outside thereof, in which a downstream end portion of the central tube can be closed and communicate with a drill shaft, and the central tube is provided with a liquid transfer aperture; the core tube which is fixedly connected to the drill shaft comprises a group of upstream and downstream core tube segments fixedly connected to one another via a first connecting member, wherein the downstream core tube segment is provided with a liquid inlet, and the core tube is slidably connected to the central tube via a limit member; and the outer tube which is connected to the core tube via a fourth shear pin comprises a group of upstream and downstream outer tube segments fixedly connected to one another via a second connecting member.

The first and second connecting members are arranged upstream and downstream of the liquid inlet respectively, and the first and second connecting members slidably contact with the outer tube and the core tube in a sealing manner respectively, so that the first connecting member, the second connecting member, the downstream core tube segment and the upstream outer tube segment together define a hydraulic chamber.

The expansion module comprises a plurality of expansion cone sheets movably mounted at a downstream end portion of the downstream outer tube segment and a cone seat fixedly arranged downstream of the expansion cone sheets.

In an initial state, the liquid transfer aperture does not communicate with the liquid inlet. As the casing expands, the central tube, with its downstream end portion being closed, moves downstream under the pressure of the liquid filled therein guided by the limit member, so that the liquid transfer aperture communicates with the liquid inlet, thus introducing the liquid into the hydraulic chamber to shear the fourth shear pin so as to drive the outer tube to move downstream, which in turn drives the expansion cone sheets to move downstream, wherein supported by the cone seat, the expansion cone sheets expand axially, so that the expansion of the casing is realized.

According to the downhole casing expansion tool of the present disclosure, a downhole casing can expand under a hydraulic pressure exerted on the downhole casing expansion tool from on the ground, so that the operations are facilitated.

In one embodiment, the limit member comprises a limit sleeve slidably disposed between the central tube and the core tube, wherein the limit sleeve connects to the core tube via a first shear pin and to the central tube via a second shear pin arranged downstream of the first shear pin, and wherein an inner wall of the core tube is provided with a radially and inwardly projecting first limit step and an outer wall of the limit sleeve is provided with a first limit ring that can engage with the first limit step. The first shear pin is sheared under the pressure of the liquid filled as the casing is expanding, so that the central tube and the limit sleeve move as a whole downstream until the first limit ring engages with the first limit step, at that time the liquid transfer aperture being communicating with the liquid inlet. In one preferable embodiment, the inner wall of the limit sleeve is provided with a radially and inwardly projecting second limit step, which can engage with a second limit ring arranged in the central tube. When the expansion cone sheets expand, the second shear pin is sheared under the increased hydraulic pressure, so that the central tube moves downstream until the second limit ring engages with the second limit step. At that time the liquid transfer aperture is communicating with the liquid inlet no longer. The hydraulic chamber is merely used for driving the outer tube to move downstream so as to enable the expansion cones to expand, and can be closed when the expansion cone sheets expand through a limit member of the same structure, so that the hydraulic chamber exerts acting forces to the first and second connecting members no longer, which is advantageous for improving the service life of the tool.

In one embodiment, the cone seat comprises a support area upstream thereof for facilitating the expansion of the expansion cone sheets, a connection area downstream thereof and a transition area between the support area and the connection area. Preferably, the support area is constructed to form a cone with a small end facing upstream. A cone seat of such shape enables the expansion cone sheets to successfully arrive at above the cone seat, i.e., the cone seat can support the expansion cone sheets, so that the expansion cone sheets can successfully expand.

In one embodiment, the downstream end portion of the central tube connects to an expansion aid for closing the central tube, the expansion aid comprising a rubber plug connecting to the downstream end portion of the central tube via a third shear pin and a rubber plug conduit fixedly connecting to the connection area of the cone seat. As the casing expands, the central tube is closed by throwing a drill shaft rubber plug therein which is capable of automatically engaging with the rubber plug.

In one embodiment, the transition area of the cone seat is provided with a blasthole and the rubber plug conduit is sealably connected to a cementing accessory sealably connected to a downstream end portion of the casing, so that the rubber plug conduit, the cementing accessory, the casing and the cone seat enclose a first sealed expansion chamber. Preferably, the rubber plug conduit is provided with a rubber plug seat therein. During an expanding period of the casing, when the expansion cone sheets expand and the second shear pin is sheared, the third shear pin is sheared under the increased hydraulic pressure, so that the rubber plug together with the drill shaft rubber plug moves downstream to seal the rubber plug seat, and the liquid flows back to a chamber of the cone seat and then into the first sealed expansion chamber via the blasthole. With the above structure, when the casing expands, the friction between the expansion cone sheets and the inner wall of the casing is significantly reduced, which is beneficial for lifting and pulling the drill shaft to expand the whole casing. In one preferable embodiment, in the initial state, the blasthole is blocked, thus preventing the outside contamination from entering inside the cone seat through the blasthole to affect the construction.

In an embodiment, a downstream portion of the blasthole in the transition area of the cone seat is provided with an annular platform which can be sealably connected to the casing. With this structure, when the blasthole is penetrated, the casing and the cone seat would enclose a small temporary sealed chamber, which can be filled by liquid, so that the expansion cone sheets and the casing are lubricated and the friction therebetween is reduced. Since the temporary sealed chamber has a relatively small volume, it can be quickly filled with liquid, reducing the time from when the liquid is to be filled to the expansion, thus improving the working efficiency. Moreover, when the temporary sealed chamber is defined by the annular platform, it can avoid cementing materials from flowing back to a contacting surface of the expansion cone sheets and the casing before the casing expands, which would render subsequent expansion construction difficult to be carried out.

In one embodiment, a hollow fixing cone fixedly connected to the downstream end portion of the outer tube is further provided, the expansion cone sheets being movably connected to a downstream portion of the fixing cone. The fixing cone is arranged to facilitate the assembling of the expansion cone sheets. In one preferable embodiment, the fixing cone forms a truncated cone with a small portion thereof facing upstream, and the inclination of the fixing cone is smaller than the inclination of an outer surface of the expansion cone sheets. With this structure, when the casing expands, the fixing cone would first slightly expand the casing, and then the expanded expansion cone sheets would expand the casing to a required level, which promotes the successful construction of the expansion.

In one embodiment, a downstream portion of the downstream core tube segment is fixedly provided with a locking connector slidably and sealably contacting with the outer tube, wherein a step portion with a reduced outer diameter which is constructed at an upstream portion of the fixing cone is inserted in between the locking connector and the outer tube to fixedly connect to the outer tube, the downstream end of which abuts a surface of the step portion. The engagement of the step structure of the fixing cone and the outer tube ensures that the fixing cone and the outer tube move as a whole, which in turn ensures that the outer tube can drive the expansion cone sheets to move. In one preferable embodiment, the locking connector is further provided with a locking member comprising a radially outward recess provided on the locking connector and a locking block connected to the recess via an elastic member. In the initial state, the step portion presses the locking block, and as the casing is expanding, under the action of the elastic member caused by the downstream movement of the step portion, the locking block radially and outwardly projects and then presses an upstream end portion of the step portion. The arrangement of such locking connector can effectively prevent the disengagement of the expansion cone sheets and the cone seat while the casing is expanding. Otherwise, the expansion construction cannot be normally carried out.

In one embodiment, the core tube comprises a plurality of core tube segments fixedly connected to one another via the first connecting member; the outer tube comprises a plurality of outer tube segments fixedly connected to one another via the second connecting member; and the first and second connecting members are both disposed upstream of the locking connector. Each and every one of the core tube segments is provided with one liquid inlet; the first connecting member is provided adjacent to each liquid inlet upstream thereof and the second connecting member is provided adjacent to each liquid inlet downstream thereof. An interval is provided between each and every adjacent first and second connecting members. In one preferable embodiment, the first connecting members are alternately arranged with the second connecting members. The downhole casing expansion tool of such structure can produce greater driving forces thanks to the plurality of second connecting members capable of receiving hydraulic pressure, thus facilitating successful casing expansion constructions.

A second aspect of the present disclosure discloses a method for expanding a casing using the above downhole casing expansion tool, comprising the following steps:

Step I: drilling an openhole and putting a first level casing down into the openhole to carry out first well cementation, wherein a downstream portion of the first level casing is pre-expanded and a downstream end portion thereof is sealed;

Step II: putting a drilling tool into the downhole to pierce the first level casing and continue drilling, wherein a side wall of the pierced first level casing forms an overlapping portion downstream thereof;

Step III: putting a second level casing and expansion tools into the downhole, wherein a downstream end portion of the second level casing is sealably provided with cementing accessories and a downstream portion of the second level casing comprises a pre-expanded expansion promoter region, upstream of which is provided with an overlapping area, the upstream portion of which is disposed in the overlapping portion of the first level casing, the expansion tool being constructed that the fixing cone thereof is arranged in the expansion promoter region;

Step IV: carrying out well cementation and putting a drill shaft rubber plug into the downhole, wherein the drill shaft rubber plug engages with the rubber plug of the expansion tool so as to seal the downstream end portion of the central tube;

Step V: filling liquid in the downhole casing expansion tool, pressing so that the second level casing expands under the function of the expansion tool, and lifting the downhole casing expansion tool so that an outer diameter of the second level casing expands to be equal to an inner diameter of the first level casing and to enable the second level casing to fixedly connect to the first level casing;

Step VI: repeating Step II to Step V and connecting an upstream portion of the downstream casing to the overlapping area of the upstream casing so as to complete multi-level casing monohole expansion operations.

Monohole expansion of casings can be achieved by the method of the present invention, i.e., the casings expand without the inner diameter being reduced, so that well drilling with no loss in well diameter (i.e., monohole well drilling) can be realized. Moreover, drills of the same specification can be adopted throughout the construction because the borehole diameter is kept consistent, thus reducing the cost in well drilling and completion and the efficiency thereof is improved.

In one embodiment, in Step III, the fixing cone of the expansion tool is constructed in such a way that an outer diameter thereof is smaller than an inner diameter of the expansion promoter region but larger than an inner diameter of the second level casing arranged upstream of the expansion promoter region, so that the expansion tool and the second level casing can be conveniently and favorably engaged with each other before the construction of the expansion.

In one embodiment, in Step IV, an unexpanded portion in a downstream portion of the casing is removed after the expansion of each level of casing is completed, so that the next level casing can successfully enter into the downhole.

In one embodiment, an outer side of the overlapping area of the second level casing is provided with a compressible filler for separating cement. In one specific embodiment, the filler is air, the compressibility of which is so large that working spaces are provided for expansion after well cementation and the problem of the overlapping area of the casing incapable of being expanded due to the restriction to the expansion caused by external cement is eliminated, thus facilitating the expansion construction after the well cementation.

In one embodiment, a sealing member is further provided between the overlapped casings, so as to ensure that the overlapped casings are sealably connected.

In the present disclosure, the term "upstream" refers to the direction towards the ground and the term "downstream" refers to the direction opposite to the upstream direction. The term "initial state" refers to a state before the expansion of the downhole casing expansion tool.

Compared with the prior art, the present disclosure is advantageous in the following aspects. At the outset, by the downhole casing expansion tool of the present disclosure, multi-level casings are expanded under hydraulic pressure, so that the casings can expand without the inner diameter being reduced (i.e., monohole well drilling can be realized). A downhole casing can expand under a hydraulic pressure exerted on the downhole casing expansion tool from on the ground, so that the operations are facilitated. The filler composed of materials capable of being compressed is provided at the outer side of the overlapping area of the second level casing, so that working spaces are provided for expansion after well cementation and the problem of the overlapping area of the casing incapable of being expanded due to the restriction to the expansion caused by external cement is eliminated. Moreover, drills of the same specification can be adopted throughout the construction because the borehole diameter is kept consistent, thus reducing the cost in well drilling and completion and the efficiency thereof is improved.

BRIEF DESCRIPTION OF DRAWINGS

In the following the present disclosure will be described in detail in view of different examples and with reference to the drawings, wherein.

Figure 1:
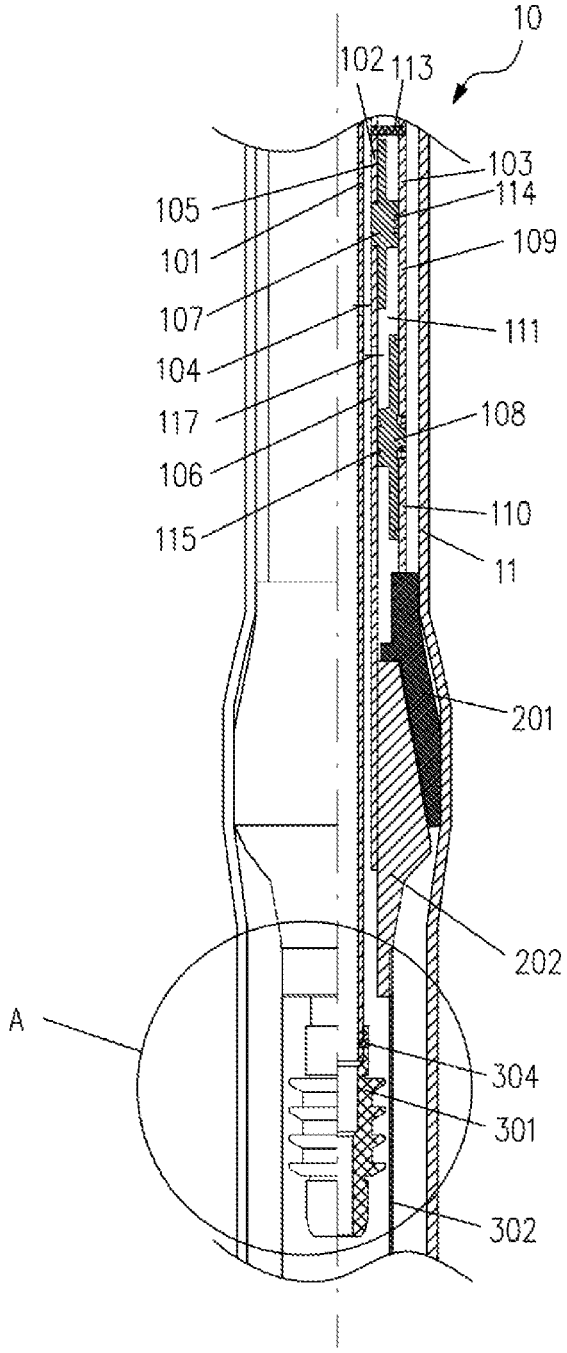
FIG. 1 is a schematic drawing of a first embodiment of the drive module of the downhole casing expansion tool according to the present disclosure.

In the drawings, the same component is indicated by the same reference sign. The drawings are not drawn in accordance with an actual scale.

DETAILED DESCRIPTION OF EMBODIMENTS

In the following, the present disclosure will be further illustrated with reference to the drawings.

FIG. 1 schematically indicates a first embodiment of a downhole casing expansion tool 10 (hereinafter referred to as an expansion tool 10) according to the present disclosure. As shown in FIG. 1, the expansion tool 10 comprises an expansion module for expanding a casing 11 and a drive module for driving the expansion module to expand, which will be described in detail in the following.

The drive module comprises a central tube 101, a core tube 102 and an outer tube 103 successively arranged from the inside to the outside thereof. The core tube 102 is fixedly connected to a drill shaft (not shown in the drawing) and the central tube 101 communicates with the drill shaft, wherein the drill shaft is a hollow shaft so as to facilitate injecting liquid in the expansion tool 10. The central tube 101 with a downstream end portion capable of being closed is provided with a liquid transfer aperture 104 on a side wall thereof. The downstream end portion of the central tube 101 extends from the core tube 102 while a downstream end portion of the core tube 102 extends from the outer tube 103, and the core tube 102 is connected to the outer tube 103 via a fourth shear pin 113 (see FIG. 3). The central tube 101 and the core tube 102 are connected via a limit member, which is indicated in FIG. 3.

The core tube 102 comprises an upstream core tube segment 105 and a downstream core tube segment 106 fixedly connected to each other via a first connecting member 107. The downstream core tube segment 106 is provided with a liquid inlet 117. The outer tube 103 comprises an upstream outer tube segment 109 and a downstream outer tube segment 110 connectedly to each other via a second connecting member 108. In addition, the first connecting member 107 slidably contacts with the outer tube 103 in a sealing manner and the second connecting member 108 slidably contacts with the core tube 102 in a sealing manner. As shown in FIG. 1, a contacting surface of the first connecting member 107 and the outer tube 103 is provided with a first sealing member 114, while a contacting surface of the second connecting member 108 and the core tube 102 is provided with a second sealing member 115. These sealing members can be selected as O-rings so as to realize the sealable contact. The first connecting member 107 and the second connecting member 108 are respectively arranged upstream and downstream of the liquid inlet 117, so that the first connecting member 107, the second connecting member 108, the downstream core tube segment 106 and the upstream outer tube segment 109 define a hydraulic chamber 111.

Still according to FIG. 1, the expansion module comprises a plurality of expansion cone sheets 201 movably arranged at a downstream end portion of the downstream outer tube 110 and a cone seat 202 fixedly arranged downstream of the expansion cone sheets 201. In the embodiment as shown in FIG. 1, the central tube 101 extends from downstream of the cone seat 202. The core tube 102 extends through the expansion cone sheets 201 and the cone seat 202 is fixedly connected to a downstream portion of the core tube 102. When the expansion cone sheets 201 move downstream to contact with the cone seat 202, the expansion cone sheets 201 would axially expand like an umbrella so as to expand the casing 11. FIG. 1 illustrates the state when the expansion cone sheets 201 expand. The structure of the cone seat 202 will be described in detail in the following.

Figure 3:
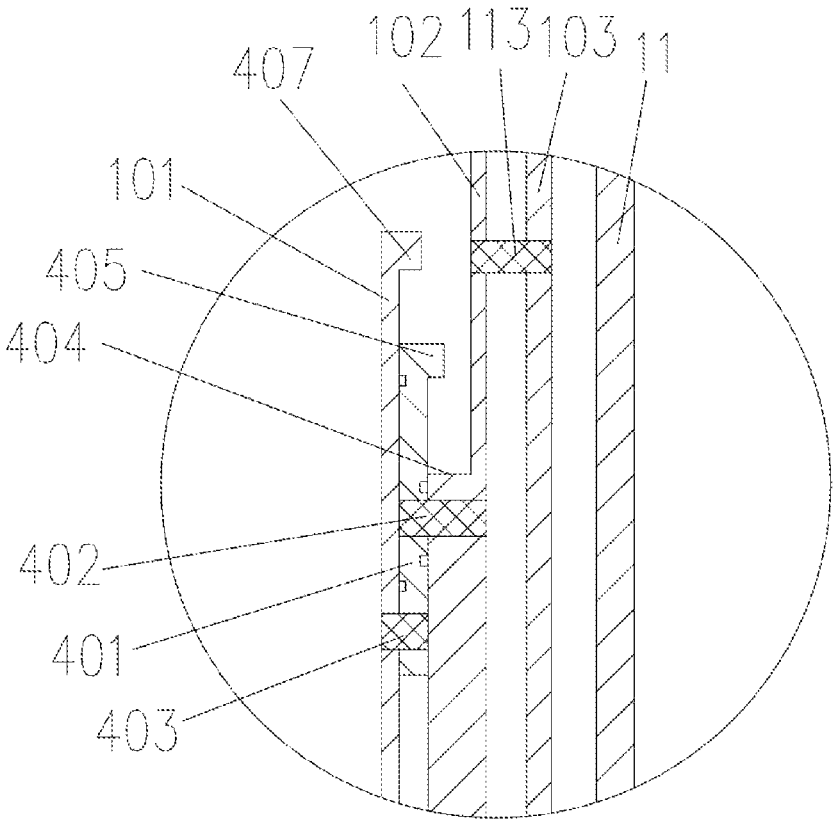
FIG. 3 is an enlarged view of the central tube limit member of the downhole casing expansion tool according to the present disclosure.

As shown in FIG. 3, the limit member comprises a limit sleeve 401 arranged between the central tube 101 and the core tube 102. The limit sleeve 401 connects to the core tube 102 via a first shear pin 402 and to the central tube 101 via a second shear pin 403 arranged downstream of the first shear pin 402. An inner wall of the core tube 102 is provided with a radially and inwardly projecting first limit step 404 and an outer wall of the limit sleeve 401 is provided with a first limit ring 405 that engages with the first limit step 404. In the embodiment as shown in FIG. 3, the first limit ring 405 is formed by a radially and outwardly projecting upstream end portion of the limit sleeve 401. Therefore, as the casing expands, when the first shear pin 402 is sheared, the central tube 101 and the limit sleeve 401 under the connection of the second shear pin 403 would move downstream as a whole until the first limit ring 405 engages with the first limit step 404. At this time, the liquid transfer aperture 104 communicates with the liquid inlet 117, so that the liquid would flow into the hydraulic chamber 111 to shear the fourth shear pin 113 to drive the outer tube 103 to move downstream.

The limit sleeve 401 is provided with a second limit step, which in the embodiment as shown in FIG. 3, can be an inner edge of the first limit ring 405. The central tube 101 is provided with a second limit ring 407 engaging with the second limit step. In the embodiment as shown in FIG. 3, the second limit ring 407 is actually formed by a radially and outwardly projecting upstream end portion of the central tube 101. When the expansion cone sheets 201 expand, the hydraulic pressure is further increased to shear the second shear pin 403, so that the central tube 101 moves downstream until the second limit ring 407 engages with the second limit step. At this time, the liquid transfer aperture 104 communicates with the liquid inlet 117 no longer and the liquid originally inside the hydraulic chamber 111 would be sealed therein. After the first limit ring 405 engages with the first limit step 404 and the second limit step engages with the second limit ring 407, the central tube 101 and the core tube 102 would move as whole instead of being disengaged.

After the expansion tool 10 is assembled and before it is expanded, the outer tube 103 is fixedly connected to the core tube 102 via the fourth shear pin 113. The central tube 101 connects to the core tube 102 via the limit member and the liquid transfer aperture 104 is arranged upstream of the liquid inlet 117 but does not communicate with the liquid inlet 117.

When the casing 11 is to be expanded, first the downstream end portion of the central tube 101 is closed. Next, liquid, such as drilling liquid is filled into the central tube 101 via the hollow drill shaft. The liquid is compressed so as to shear the first shear pin 402, which leads the central tube 101 and the limit sleeve 401 to move together downstream until the first limit ring 405 engages with the first limit step 404 and the liquid transfer aperture 104 communicates with the liquid inlet 117. In this way, liquid would flow from the central tube 101 via the liquid transfer aperture 104 and the liquid inlet 117 into the hydraulic chamber 111. Since a stress surface downstream of the hydraulic chamber 111 is the second connecting member 108 connected to the outer tube 103 and the core tube 102 connected to the drill shaft is fixed and stationary, the fourth shear pin 113 would be sheared under the downstream hydraulic pressure, so that the outer tube 103 moves downstream and drives the expansion cone sheets 201 to move downstream. When the expansion cone sheets 201 enter between the cone seat 202 and the casing 11, or when the cone seat 202 is between the expansion cone sheets 201 and the core tube 102, the expansion cone sheets 201 would radially expand (i.e., to form an umbrella), so that the expansion of the casing 11 is realized as shown in FIG. 1. When the drill shaft is lifted, driven by the core tube 102 and the cone seat 202 fixedly connected to the core tube 102, the central tube 101, the core tube 102 and the outer tube 103 would be lifted out as a whole, during which period, the expansion cone sheets 201 are still kept radially expanded, so that the expansion of the whole casing 11 is realized.

Figure 2:
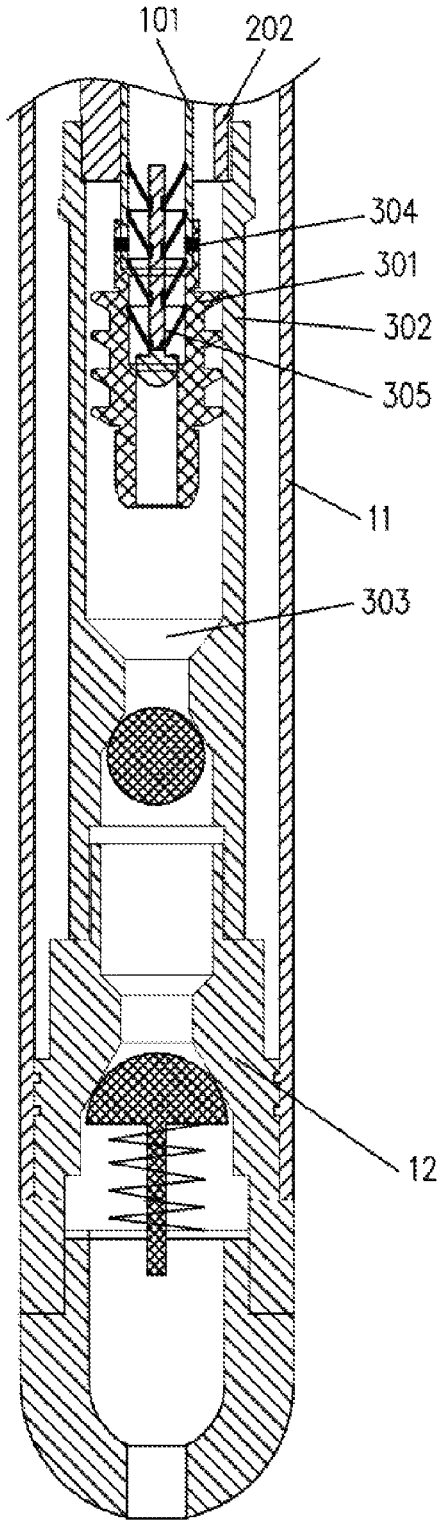
FIG. 2 is a full view of part A of FIG. 1.

In order to conveniently close the central tube 101, an expansion aid is provided at the downstream end portion of the central tube 101 as shown in FIGS. 1 and 2. The expansion aid comprises a rubber plug 301 connected to the downstream end portion of the central tube 101 via a third shear pin 304, a rubber plug conduit 302 fixedly connected to a downstream end portion of the cone seat 202, wherein the rubber plug 301 is arranged within an region of the rubber plug conduit 302. A rubber plug seat 303 is provided in the rubber plug conduit 302. When the rubber plug 301 is separated from the central tube 101, the rubber plug 301 would move downstream to close the rubber plug seat 303. Before the expansion construction is carried out, a drill shaft rubber plug 305 (as shown in FIG. 2) is first thrown into the central tube 101, wherein the drill shaft rubber plug 305 would automatically engage with the rubber plug 301 so as to close the downstream end portion of the central tube 101.

Figure 4:
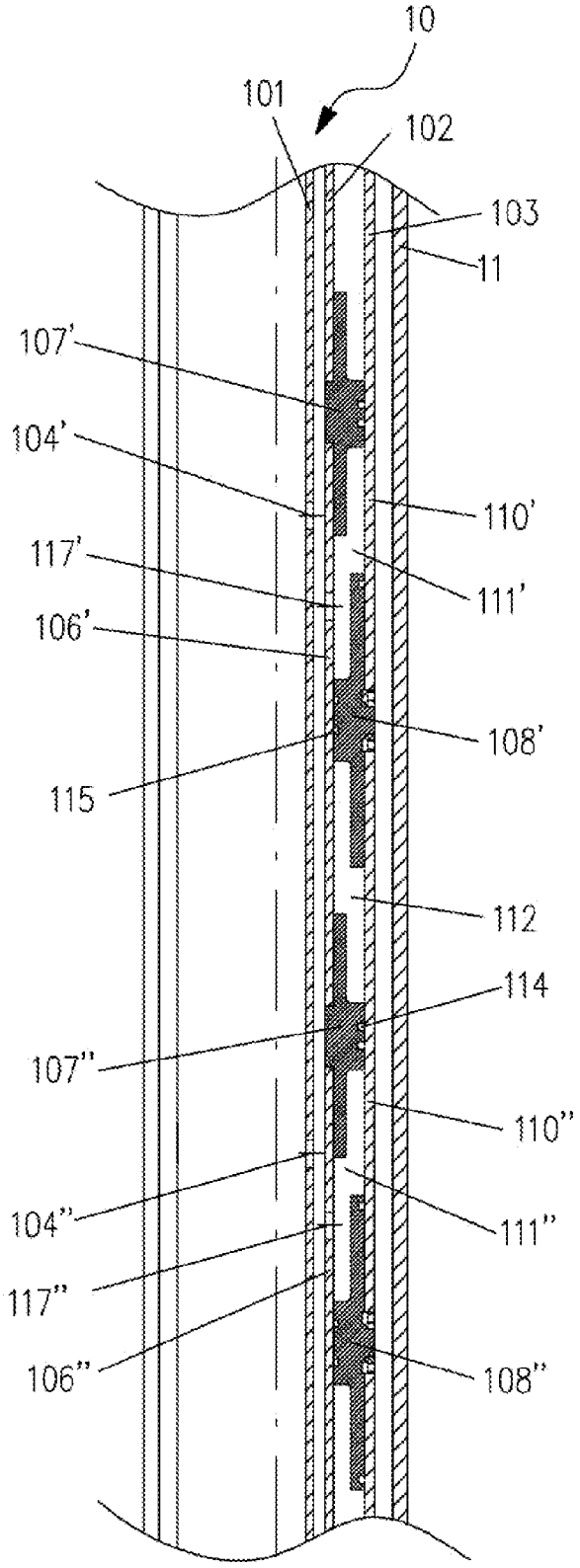
FIG. 4 is a schematic drawing of a second embodiment of the drive module of the downhole casing expansion tool according to the present disclosure.

It should be understood that, as shown in FIG. 4, the core tube 102 of the drive module of the expansion tool 10 can comprise a plurality of core tube segments 106', 106" fixedly connected to one another via first connecting members 107', 107", while the outer tube 103 can comprise a plurality of outer tube segments 110', 110" fixedly connected to one another via second connecting members 108', 108". Each and every core tube segment is provided with a liquid inlet, such as 117', 117" and the central tube 101 is provided with a plurality of liquid transfer apertures 104', 104", so that the drive module would comprise a plurality of hydraulic chambers 111', 111" (as shown in FIG. 4), which can produce greater driving forces so as to facilitate the successful expansion construction of the casings. In the embodiment as shown in FIG. 4, it should be further noted that as a matter of fact, the plurality of hydraulic chambers are separately distributed, i.e., an empty cavity 112 always exists between two adjacent hydraulic chambers, so that during the expansion construction, a downstream driving force exerted on the second connecting member 108 would not be offset. In the embodiment as indicated in FIG. 4, the expansion module, the limit member and the expansion aid are respectively identical as have been recited above and will not be repeated for the sake of simplicity.

Figure 6:
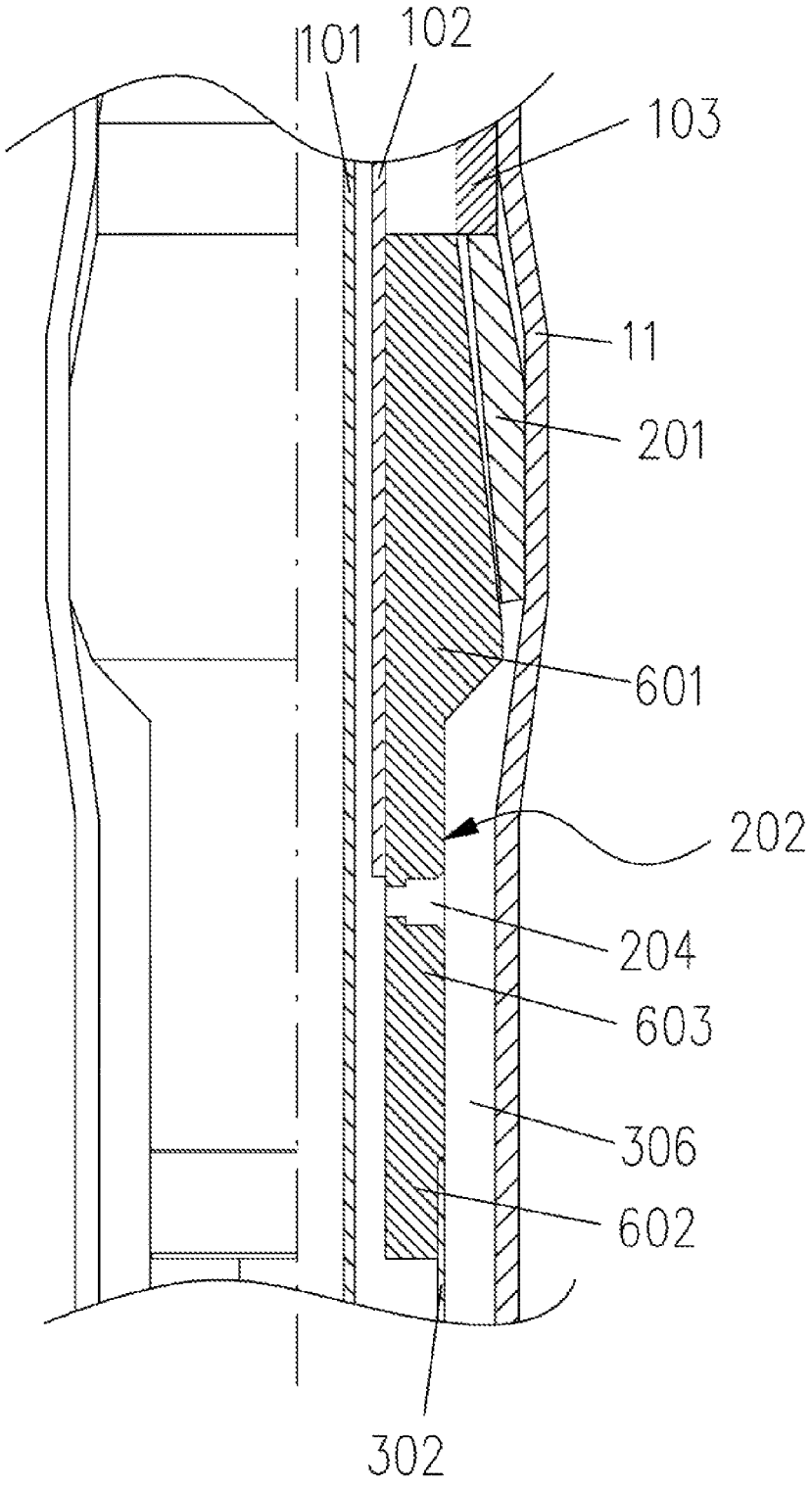
FIG. 6 is a schematic drawing of the cone seat.

As shown in FIG. 6, the cone seat 202 comprises three parts: a support area 601 upstream thereof, a connection area 602 downstream thereof and a transition area 603 between the support area 601 and the connection area 602. The support area 601 is used for facilitating the expansion of the expansion cone sheets 201 during the expansion construction. In one preferable embodiment, the support area 601 is constructed to form a cone with a small end facing upstream, so that the expansion cone sheets 201 can successfully reach the cone seat 202 so as to successfully realize the expansion of the expansion cone sheets 201. Moreover, the cone-shaped support area 601 is also a separate part fixed at the core tube 102.

In order to facilitate lifting and pulling the expansion tool 10 upward, a blasthole 204 is provided in the transition area 603 of the cone seat 202, which is shown in FIG. 6. The rubber plug conduit 302 is sealably connected to a cementing accessory 12 sealably connected downstream of the casing 11, so that the rubber plug conduit 302, the cementing accessory 12, the casing 11 and the cone seat 12 define a first sealed expansion chamber 306.

In an initial state, the blasthole 204 is blocked by a sheet-body (not shown in the drawing) such as a sheetmetal. During an expanding period of the casing 11, when the expansion cone sheets 201 radially expand and continue to press the liquid to shear the third shear pin 304, so that the rubber plug 301 together with the drill shaft rubber plug 305 moves downstream to seal the rubber plug seat 303. The liquid flows back to a chamber of the cone seat 202 through an interval between the central tube 101 and the cone seat 202 and then into the first sealed expansion chamber 306 via the blasthole 204. When the first sealed expansion chamber 306 is filled by liquid, a contacting surface between the expansion cone sheets 201 and the casing 11 will be lubricated, so that the friction between the expansion cone sheets 201 and the casing 11 is reduced, which is beneficial for pulling and lifting the expansion tool 10 upward.

Figure 7:
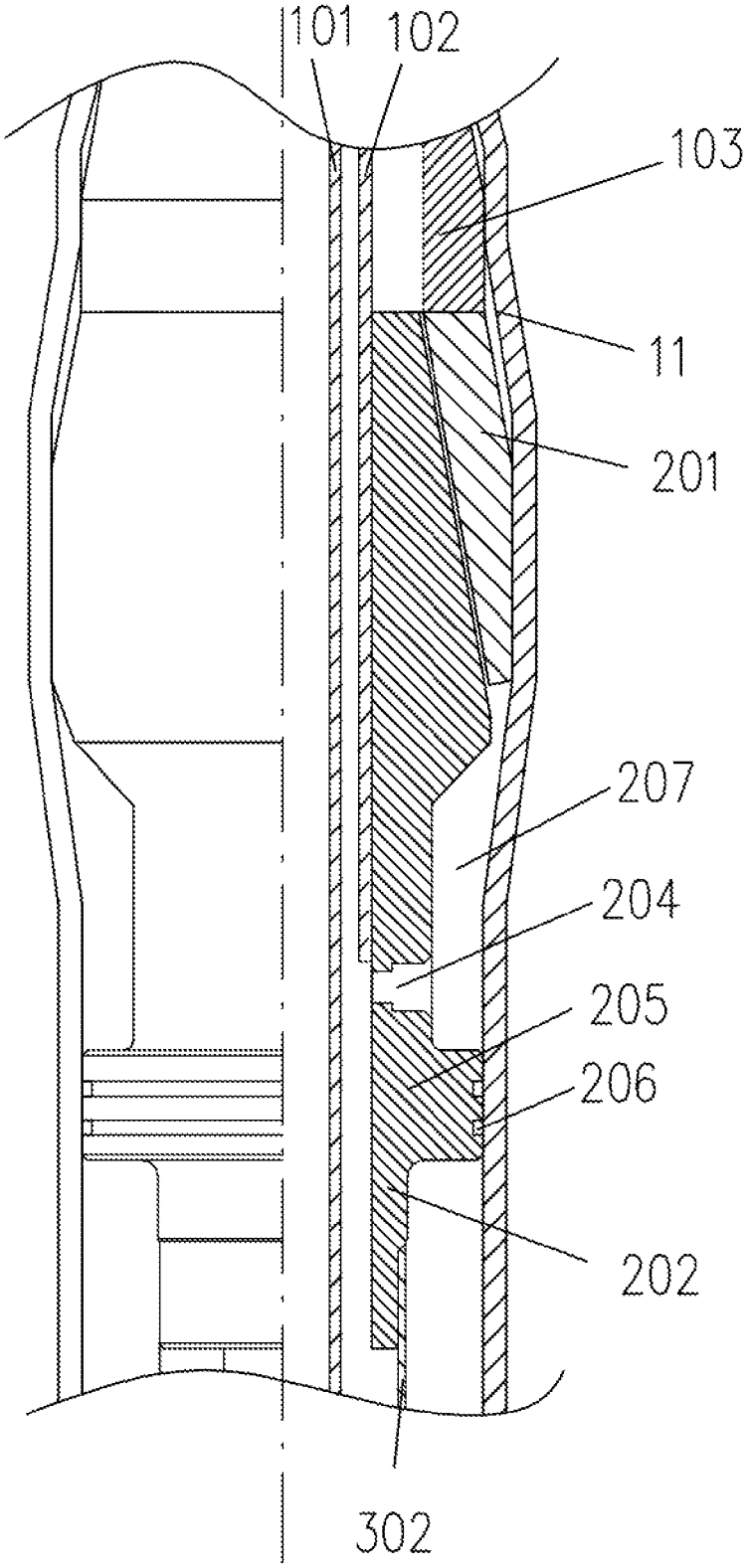
FIG. 7 is another schematic drawing of the cone seat.

In one preferable embodiment, as shown in FIG. 7, a downstream portion of the blasthole 204 in a circumferential side wall of the cone seat 202 is provided with an annular platform 205. In the initial state, the annular platform 205 is sealably connected to the casing 11, which can be achieved by a third sealing member 206 provided on a side surface of the annular platform 205. In this manner, the casing 11 and the cone seat 202 enclose a small temporary sealed chamber 207. As the casing 11 expands, the liquid reflux would break through the blasthole 204 and enter into the temporary sealed chamber 207. Since the temporary sealed chamber 207 has a volume smaller than the first sealed expansion chamber 306, the liquid would fill the temporary sealed chamber 207 in a very short time, so that the contacting surface area of the expansion cone sheets 201 and the casing 11 can be lubricated and the time period from filling the liquid to lifting and pulling the expansion tool 10 is shortened and the working efficiency is thus improved. In addition, the temporary sealed chamber 207 formed by providing the annular platform 205 can prevent the liquid in the well (such as drilling liquid, cement slurry, etc.) and impurities from flowing back to the temporary sealed chamber 207 before the expansion construction of the casing, which would render it difficult to carry out subsequent expansion construction. In pulling and lifting the expansion tool 10 upstream, when the annular platform 205 enters into the expanded casing, the temporary sealed chamber 207 would form a whole with the first sealed expansion chamber 306, so that the liquid would also fill the first expansion chamber 306 and continue to carry out the expansion of the casing.

Figure 5:
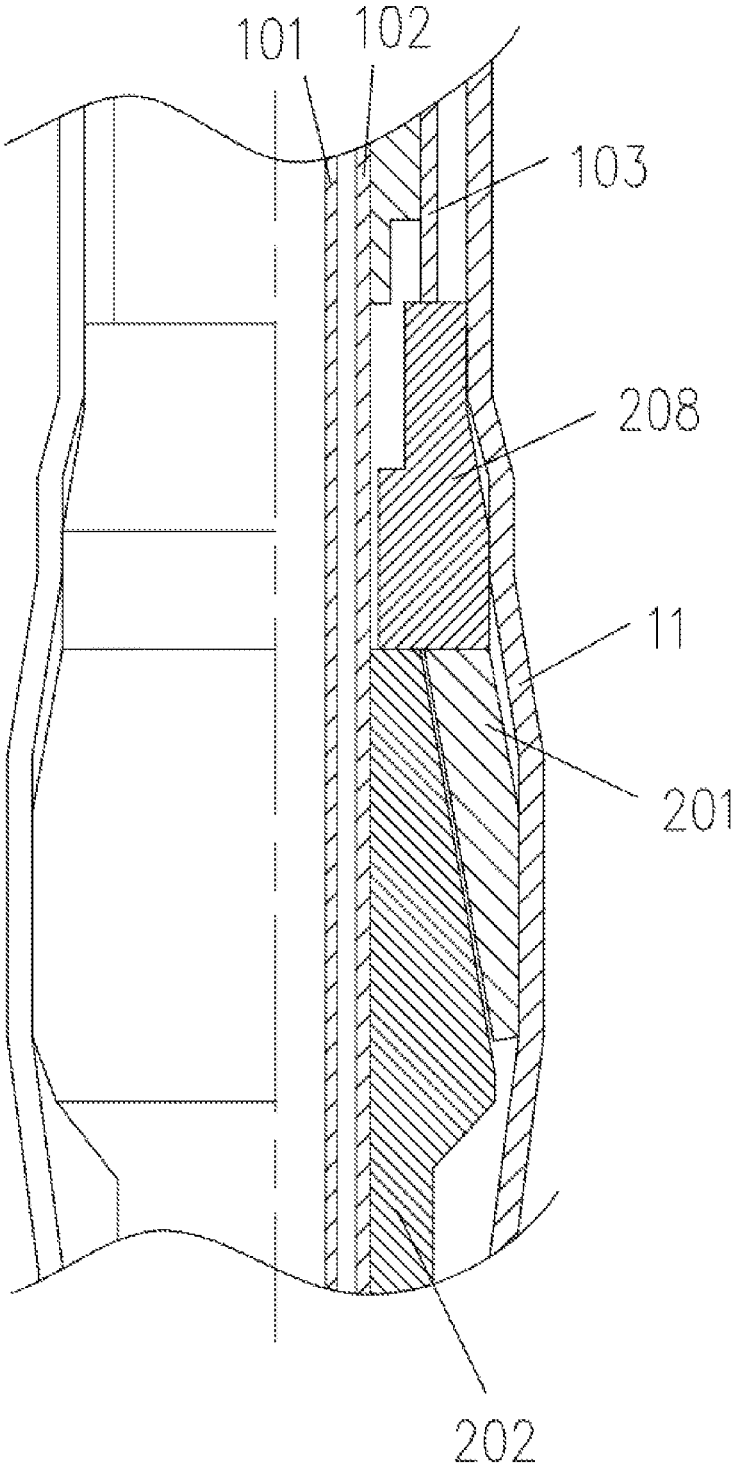
FIG. 5 is a schematic drawing of the setting mode of the expansion cone sheets of the downhole casing expansion tool according to the present disclosure.

In order to facilitate the assembling of the expansion cone sheets 201, as shown in FIG. 5, the expansion cone sheets 201 is connected to the outer tube 103 via a fixing cone 208. The fixing cone can be constructed as a hollow truncated cone to be coupled to a downstream portion of the core tube 102 and the fixing cone 208 is configured with a small end facing upstream and connected to the downstream end portion of the outer tube 103 and a large end facing downstream and movably connected to the expansion cone sheets 201. In one preferable embodiment, the inclination of a side surface of the fixing cone 208 is smaller than the inclination of an outer surface of the expansion cone sheets 201. In the present disclosure, the term "inclination" refers to the dip angle formed by an element of the fixing cone 208 and a central axis of the casing 11, or the dip angle formed by the outline of the expansion surface of the expansion cone sheets 201 as indicated in FIG. 5 relative to the central axis of the casing 11. The concept of "inclination" is well known by one skilled in the art. In addition, the largest diameter of the fixing cone 208 is still smaller than the largest diameter of the expanded expansion cone sheets 201. The advantages of the structure of the fixing cone 208 will be described in the following.

Figure 8:
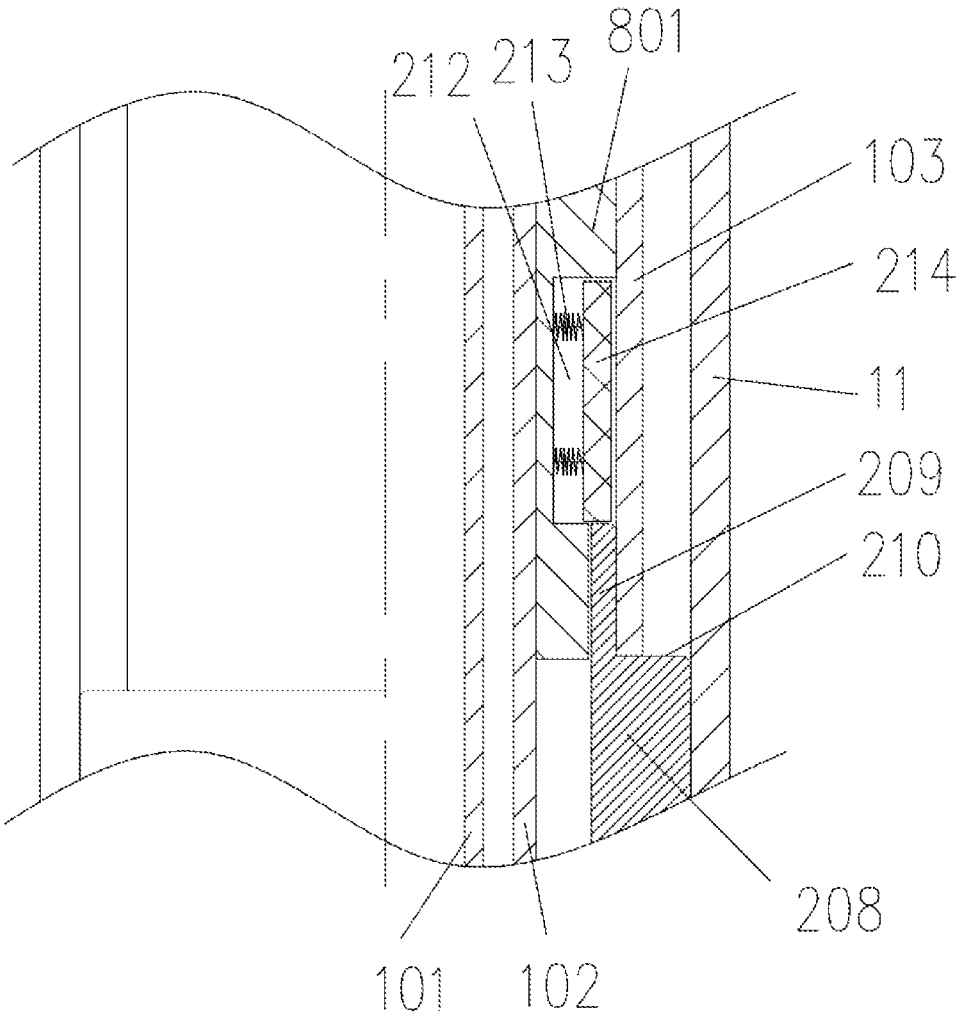
FIG. 8 is an enlarged view of the locking member according to the present disclosure.

As shown in FIG. 8, in order to ensure that the outer tube 103 drives the fixing cone 208 to move, a downstream portion of the downstream core tube segment 102 is fixedly provided with a locking connector 801 slidably and sealably contacting with the outer tube 103. And a step portion 209 with a reduced outer diameter which is constructed at an upstream portion of the fixing cone 208 is inserted in between the locking connector 801 and the outer tube 103 to fixedly connect to the outer tube 103, the downstream end of which abuts a surface 210 of the step portion. In such a manner, when the expansion cone sheets 201 expand, the fixing cone 208 moves downstream to drive the expansion cone sheets 201 to move downstream so that the expansion cone sheets 201 expand. In lifting the drill shaft, the fixed connection of the outer tube 103 and the fixing cone 208 would drive the expansion cone sheets 201 to move upstream, while the cone seat 202 would move upstream at the same speed, so that the expansion cone sheets 201 would not disengage with the cone seat 202 and thus would not be closed. In one preferable embodiment, the locking connector 801 is further provided with a locking member. As shown in FIG. 8, the locking member comprises a radially outward recess 212 provided on the locking connector 801 and a locking block 214 connected to the recess 212 via an elastic member 213. In the initial state, the step portion 209 would press the locking block 214, and as the casing is expanding, the step portion 209 moves downstream and leaves the locking block 214, which, under the action of the elastic member 213, radially and outwardly projects and presses an upstream end portion of the step portion 209, so that in lifting the expansion tool 10, the locking block 214 would constraint the fixing cone 208 to avoid the expansion cone sheets 201 from disengaging with the cone seat 202.

Figure 9:
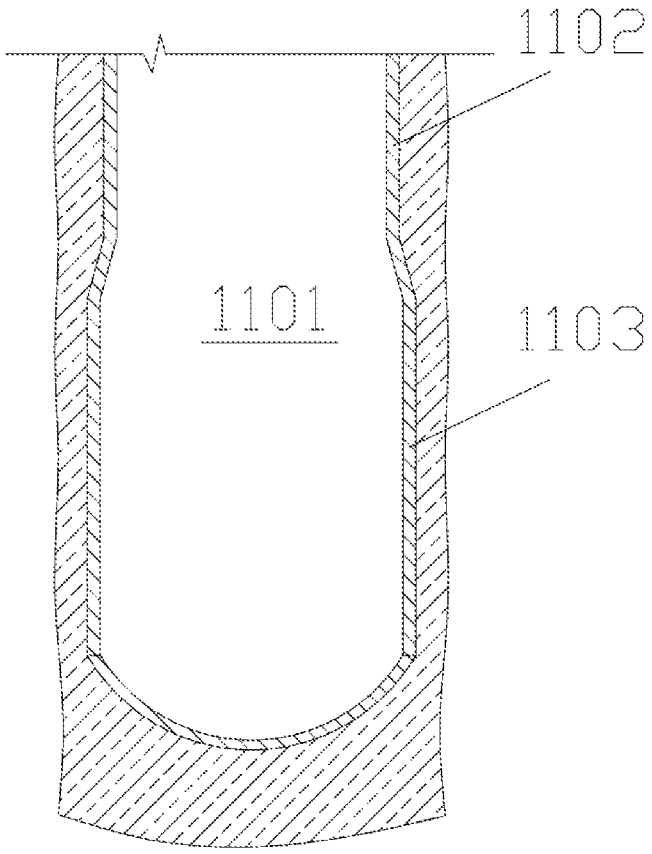
FIGS. 9 to 15 schematically show the steps of expanding a casing with the downhole casing expansion tool according to the present disclosure.
Figure 10:
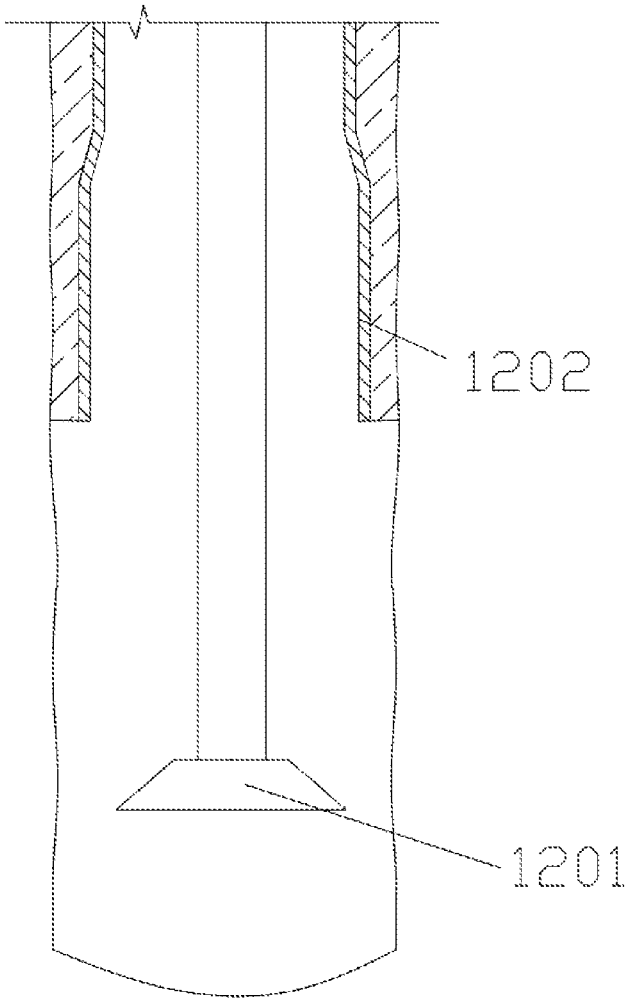
Figure 11:
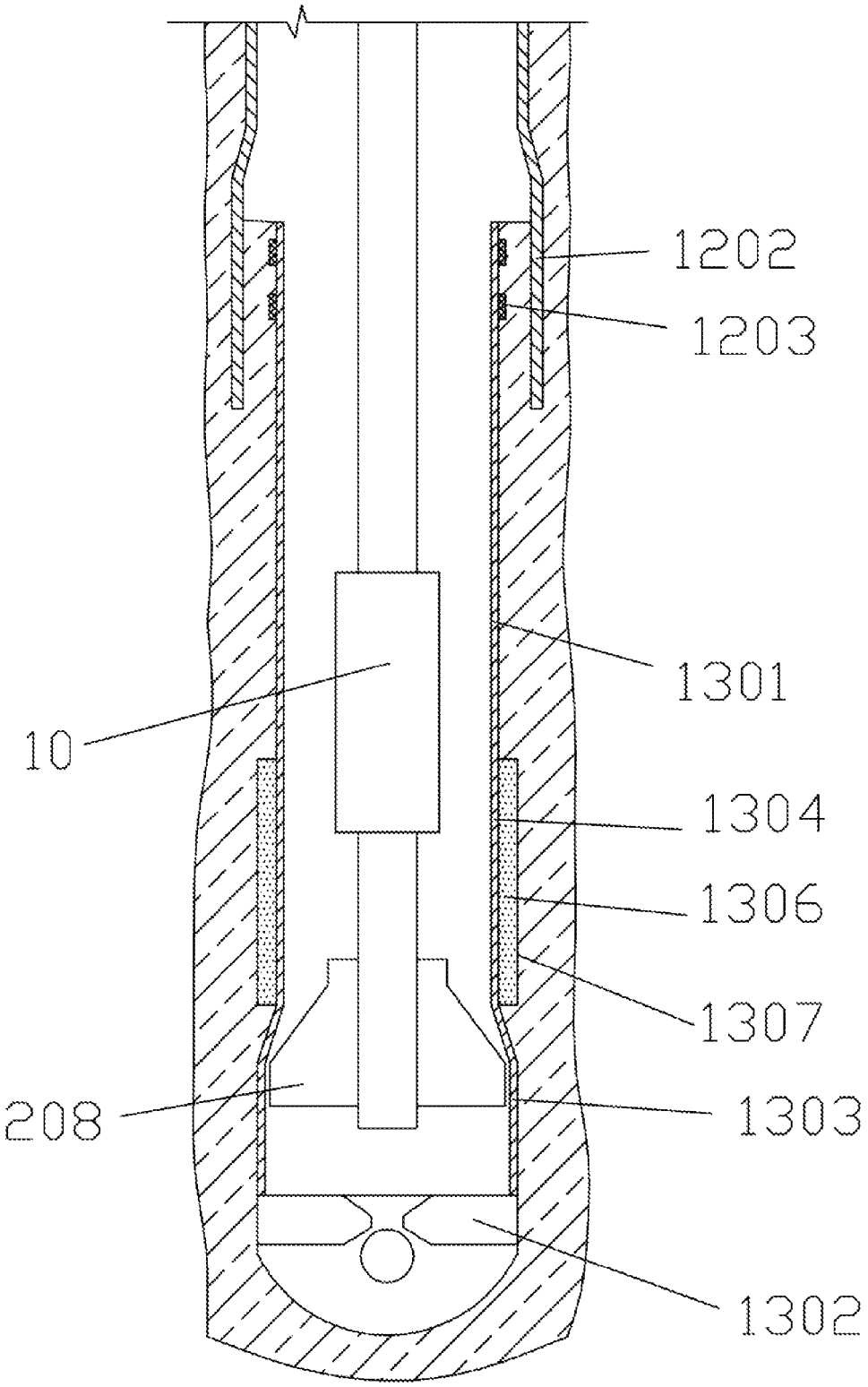

In the following the method of expanding the casing 11 with the expansion tool 10 will be described according to FIGS. 1 to 15, comprising:

Step I: as shown in FIG. 9, drilling an openhole 1101 and putting a first level casing 1102 down into the openhole 1101 to carry out first well cementation, wherein before the first level casing 1102 is put down into the openhole 1101, a downstream portion 1103 of the first level casing 1102 is pre-expanded and a downstream end portion thereof is sealed;

Step II: as shown in FIG. 10, putting a drilling tool 1201 into the downhole to pierce the first level casing 1102 and continue the drilling, wherein according to actual conditions, openhole expansion operations can be carried out to provide an openhole space for realizing monohole well drilling, and wherein a side wall of the pierced first level casing 1102 forms an overlapping portion 1202 downstream thereof;

Step III: as shown in FIG. 11, putting a second level casing 1301 and the expansion tool 10 into the downhole and arranging an upstream portion of the second level casing 1301 in the overlapping portion 1202 of the first level casing, wherein a downstream end portion of the second level casing 1301 is sealably provided with cementing accessories 1302 and a downstream portion of the second level casing 1301 comprises a pre-expanded expansion promoter region 1303, upstream of which is provided with an overlapping area 1304, and the expansion tool 10 is configured that the fixing cone 208 thereof is arranged in the expansion promoter region 1303, the cementing accessories 1302 being apparatuses such as float collars, float shoes, etc., which are all well known by one skilled in the art and will not be repeated.

Figure 12:
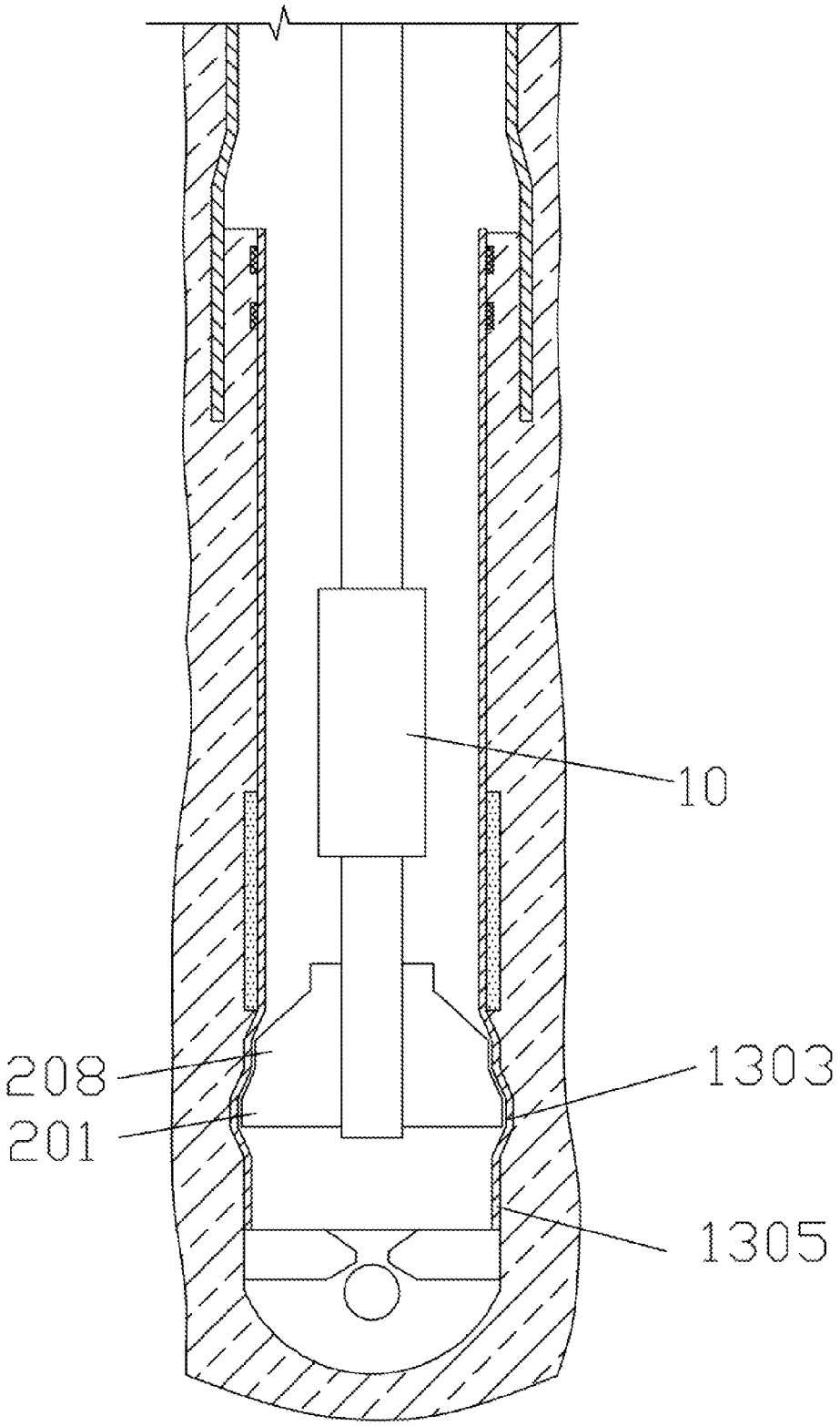
Figure 13:
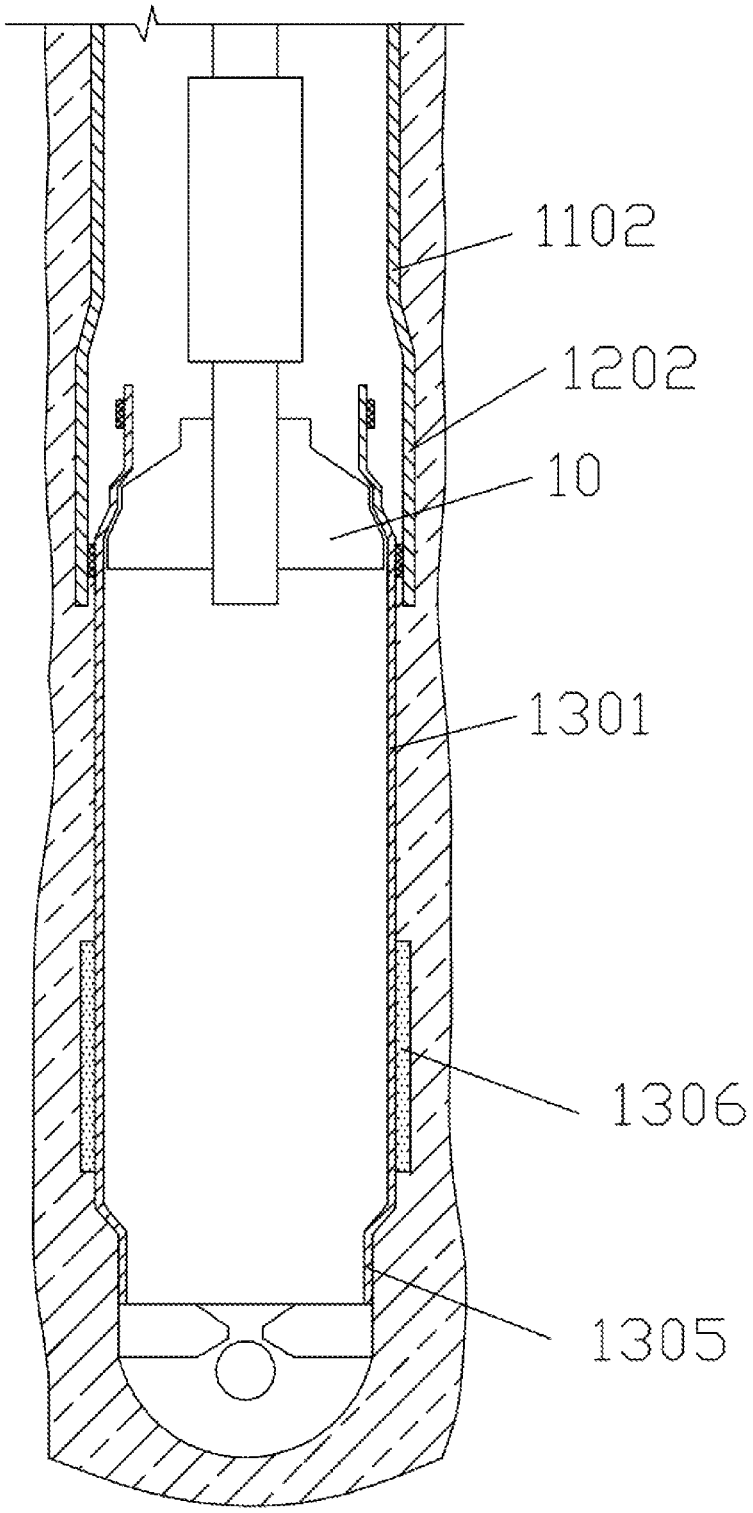
Figure 14:
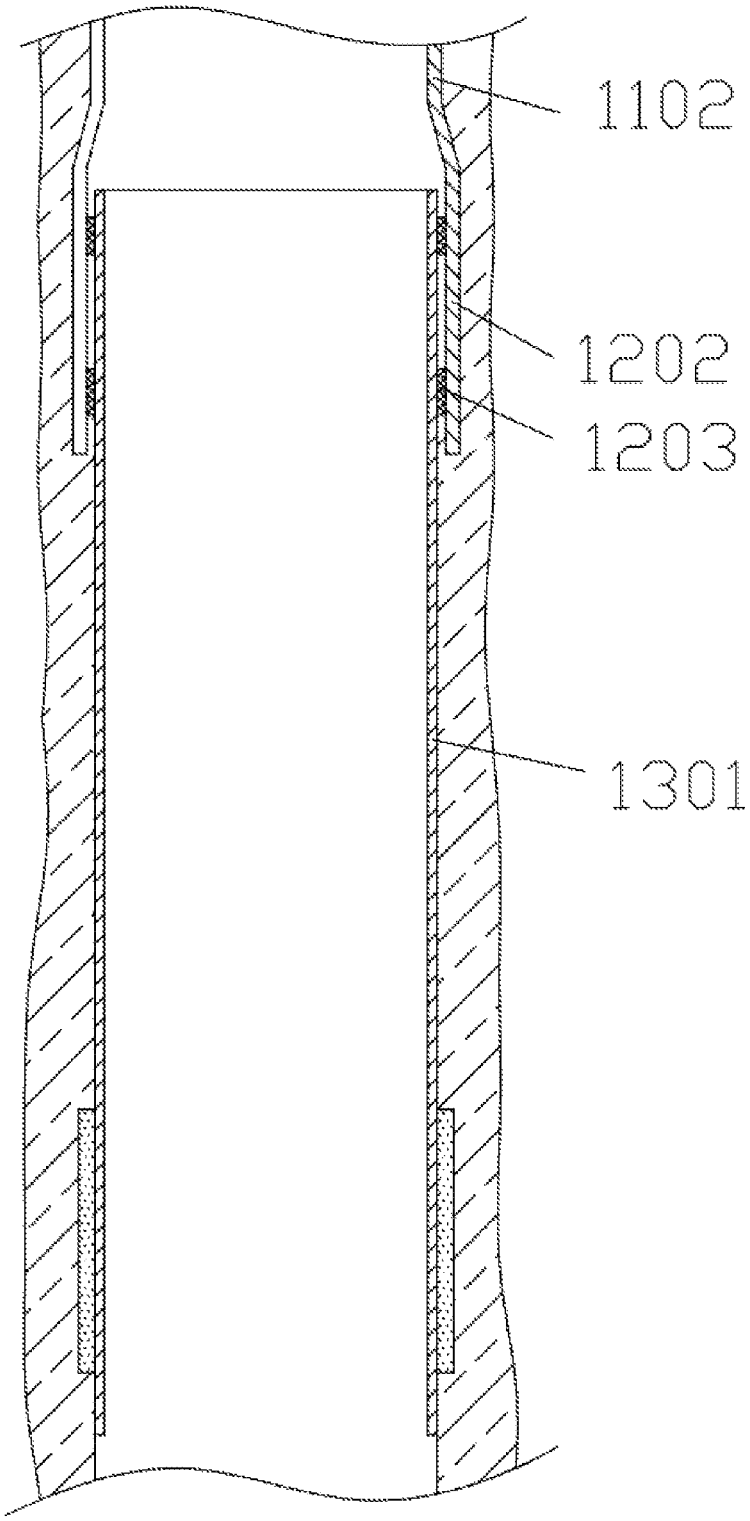
Figure 15:
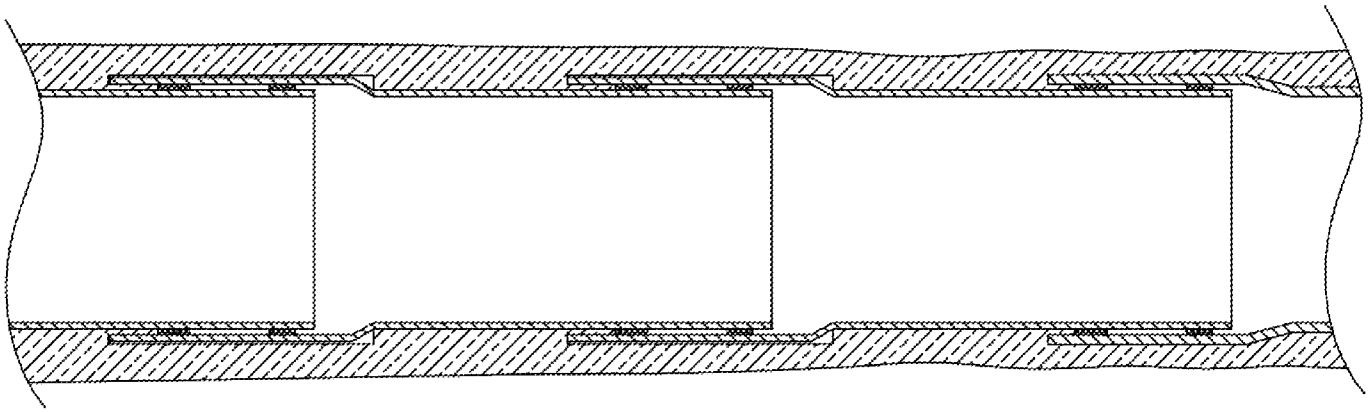

Step IV: carrying out well cementation and putting a drill shaft rubber plug 305 into the downhole, wherein the drill shaft rubber plug 305 engages with the rubber plug 301 of the expansion tool so as to seal the downstream end portion of the central tube 101; in one embodiment, slow setting cement is selected for the well cementation, so that the expansion of the casing 11 can be ensured to be completed before the slurry thickening of the cement;

Step V: as shown in FIG. 12, filling liquid in the expansion tool 10, and pressing the expansion cone sheets 201 to expand them, so that the second level casing 1301 is expanded by the expansion tool 10, and as shown in FIGS. 13 and 14, lifting the downhole casing expansion tool 10 so as to expand an outer diameter of the second level casing 1301 to be equal to an inner diameter of the first level casing 1102 and to enable the second level casing 1301 to fixedly connect to the overlapping portion 1202 of the first level casing 1102;

Step VI: as shown in FIG. 15, repeating Step II to Step V and connecting an upstream portion of the downstream casing to the overlapping area of the upstream casing so as to complete multilevel casing monohole expansion operations.

It should be noted that, in the method according to the present disclosure, except that the downstream portion 1103 of the first level casing 1102 is pre-expanded, other casings are not pre-expanded before they are put into the downhole. Instead, they are expanded for once by the expansion tool 10, in which the inner diameters thereof are expanded to be equal to the inner diameter of the first level casing 1102.

By the method of the present disclosure, monohole expansion of multi-casings is realized, i.e., as shown in FIG. 15, after expansion, the inner diameters of all the casings can be equal to the inner diameter of the upstream casings. Therefore, well drilling with no loss in well diameter (i.e., monohole well drilling) can be realized. Moreover, drills of the same specification can be adopted throughout the construction because the borehole diameter is kept consistent, thus reducing the cost in well drilling and completion and the efficiency thereof is improved.

In one embodiment, the fixing cone 208 of the expansion tool 10 is constructed in such a way that the outer diameter thereof is smaller than the inner diameter of the expansion promoter region 1303 but larger than the inner diameter of the second level casing 1301 arranged upstream of the expansion promoter region 1303, so that before the expansion construction, the expansion tool 10 can be conveniently engaged with the second level casing 1301, which is beneficial for the expansion construction. In addition, as recited above, the inclination of the side surface of the fixing cone 208 is smaller than the inclination of the outer surface of the expansion cone sheets 201, and the largest diameter of the fixing cone 208 is still smaller than the largest diameter of the expanded expansion cone sheets 201. In carrying out the expansion operations, the fixing cone 208 would first slightly expand the casing 11 and the expanded expansion cone sheets 201 would expand the casing 11 to a required monohole size, so that the fixing cone 208 and the expansion cone sheets 201 actually realize a double-level expansion, which can facilitate the successful operations of the expansion construction.

As shown in FIG. 14, to ensure that the construction can be successfully carried out, in Step V, after each level casing is expanded, an unexpanded portion 1305 at the downstream portion of the casings should be removed, which can be realized, for example by throwing milling tools in the downhole. In order to improve the connection tightness of multilevel casings, a fourth sealing member 1203, such as a rubber tube or a soft metal member, etc. is further provided between overlapping casings. After being expanded and overlapped, the casing 11 is compressed between two casings to realize the sealing tightness. A filler 1306 for separating cement is provided on an outer side of the casing 11 in the overlapping area 1304. In one embodiment, the filler 1306 is a compressible material, such as air (i.e., a cavity 1307 for separating cement is provided on an outer side of the overlapping area 1304 of the second level casing 1301). During the well cementing and expansion operations, the cavity 1307 can separate cement, i.e., no cement ring can be formed in the cavity 1307, so that working spaces are provided for the expansion and overlapping of the second level casing 1301 and the overlapping area 1304 and outside cement rings are prevented from constraining the expansion thereof.

Although the present disclosure has been discussed with reference to preferable examples, it extends beyond the specifically disclosed examples to other alternative examples and/or use of the disclosure and obvious modifications and equivalents thereof. The scope of the present disclosure herein disclosed should not be limited by the particular disclosed examples as described above, but encompasses any and all technical solutions following within the scope of the following claims.

The invention claimed is:

1. A downhole casing expansion tool comprising an expansion module for expanding a casing and a drive module for driving the expansion module to expand, wherein the drive module comprises a central tube, a core tube and an outer tube successively arranged from inside to outside of the drive module, in which a downstream end portion of the central tube can be closed and communicate with a drill shaft, and the central tube is provided with a liquid transfer aperture; the core tube which is fixedly connected to the drill shaft comprises a group of upstream and downstream core tube segments fixedly connected to one another via a first connecting member, wherein the downstream core tube segment is provided with a liquid inlet, and the core tube is slidably connected to the central tube via a limit member; and the outer tube which is connected to the core tube via a fourth shear pin comprises a group of upstream and downstream outer tube segments fixedly connected to one another via a second connecting member, wherein the first and second connecting members are arranged upstream and downstream of the liquid inlet respectively, and the first and second connecting members slidably contact with the outer tube and the core tube in a sealing manner respectively, so that the first connecting member, the second connecting member, the downstream core tube segment and the upstream outer tube segment together define a hydraulic chamber, wherein the expansion module comprises a plurality of expansion cone sheets movably mounted at a downstream end portion of the downstream outer tube segment and a cone seat fixedly arranged downstream of the expansion cone sheets, wherein in an initial state, the liquid transfer aperture does not communicate with the liquid inlet, and wherein as the casing expands, the central tube, with its downstream end portion being closed, moves downstream under the pressure of the liquid filled therein guided by the limit member, so that the liquid transfer aperture communicates with the liquid inlet, thus introducing the liquid into the hydraulic chamber to shear the fourth shear pin so as to drive the outer tube to move downstream, which in turn drives the expansion cone sheets to move downstream, wherein supported by the cone seat, the expansion cone sheets expand axially, so that the expansion of the casing is realized.

2. The downhole casing expansion tool according to claim 1, wherein the limit member comprises a limit sleeve slidably disposed between the central tube and the core tube, wherein the limit sleeve connects to the core tube via a first shear pin and to the central tube via a second shear pin arranged downstream of the first shear pin, and wherein an inner wall of the core tube is provided with a radially and inwardly projecting first limit step and an outer wall of the limit sleeve is provided with a first limit ring that can engage with the first limit step, wherein the first shear pin is sheared under the pressure of the liquid filled as the casing is expanding, so that the central tube and the limit sleeve move as a whole downstream until the first limit ring engages with the first limit step, at that time the liquid transfer aperture being communicating with the liquid inlet.

3. The downhole casing expansion tool according to claim 2, wherein the inner wall of the limit sleeve is provided with a radially and inwardly projecting second limit step, which can engage with a second limit ring arranged in the central tube, wherein when the expansion cone sheets expand, the second shear pin is sheared under the increased hydraulic pressure, so that the central tube moves downstream until the second limit ring engages with the second limit step, at that time the liquid transfer aperture being communicating with the liquid inlet no longer.

4. The downhole casing expansion tool according to claim 3, wherein the cone seat comprises a support area upstream thereof for facilitating the expansion of the expansion cone sheets, a connection area downstream thereof and a transition area between the support area and the connection area.

5. The downhole casing expansion tool according to claim 4, wherein the support area is constructed to form a cone with a small end facing upstream.

6. The downhole casing expansion tool according to claim 4, wherein the downstream end portion of the central tube connects to an expansion aid for closing the central tube, the expansion aid comprising a rubber plug connecting to the downstream end portion of the central tube via a third shear pin and a rubber plug conduit fixedly connecting to the connection area of the cone seat, wherein as the casing expands, the central tube is closed by throwing a drill shaft rubber plug therein which is capable of automatically engaging with the rubber plug.

7. The downhole casing expansion tool according to claim 6, wherein the transition area of the cone seat is provided with a blasthole and the rubber plug conduit is sealably connected to a cementing accessory sealably connected to a downstream end portion of the casing, so that the rubber plug conduit, the cementing accessory, the casing and the cone seat enclose a first sealed expansion chamber.

8. The downhole casing expansion tool according to claim 7, wherein the rubber plug conduit is provided with a rubber plug seat therein, wherein during an expanding period of the casing, when the expansion cone sheets expand and the second shear pin is sheared, the third shear pin is sheared under the increased hydraulic pressure, so that the rubber plug together with the drill shaft rubber plug moves downstream to seal the rubber plug seat, and the liquid flows back to a chamber of the cone seat and then into the first sealed expansion chamber via the blasthole.

9. The downhole casing expansion tool according to claim 8, wherein a downstream portion of the blasthole in the transition area of the cone seat is provided with an annular platform which can be sealably connected to the casing.

10. The downhole casing expansion tool according to claim 9, wherein a hollow fixing cone fixedly connected to the downstream end portion of the outer tube is further provided, the expansion cone sheets being movably connected to a downstream portion of the fixing cone.

11. The downhole casing expansion tool according to claim 10, wherein the fixing cone forms a truncated cone with a small portion thereof facing upstream, and the inclination of the fixing cone is smaller than the inclination of an outer surface of the expansion cone sheet.

12. The downhole casing expansion tool according to claim 10, wherein a downstream portion of the downstream core tube segment is fixedly provided with a locking connector slidably and sealably contacting with the outer tube, wherein a step portion with a reduced outer diameter which is constructed at an upstream portion of the fixing cone is inserted in between the locking connector and the outer tube to fixedly connect to the outer tube, the downstream end of which abuts a surface of the step portion.

13. The downhole casing expansion tool according to claim 12, wherein the locking connector is further provided with a locking member comprising a radially outward recess provided on the locking connector and a locking block connected to the recess via an elastic member, wherein in the initial state, the step portion presses the locking block, and as the casing is expanding, under the action of the elastic member caused by the downstream movement of the step portion, the locking block radially and outwardly projects and then presses an upstream end portion of the step portion.

14. The downhole casing expansion tool according to claim 12, wherein the core tube comprises a plurality of core tube segments fixedly connected to one another via the first connecting member; the outer tube comprises a plurality of outer tube segments fixedly connected to one another via the second connecting member; and the first and second connecting members are both disposed upstream of the locking connector, wherein each and every one of the core tube segments is provided with one liquid inlet; the first connecting member is provided adjacent to each liquid inlet upstream thereof, the second connecting member is provided adjacent to each liquid inlet downstream thereof, and an interval is provided between each and every adjacent first and second connecting members.

15. The downhole casing expansion tool according to claim 14, wherein the first connecting members are alternately arranged with the second connecting members.

16. The downhole casing expansion tool according to claim 7, wherein in the initial state, the blasthole is blocked.

17. A method for expanding a casing using the downhole casing expansion tool according to claim 1, comprising the following steps:

Step I: drilling an openhole and putting a first level casing down into the openhole to carry out first well cementation, wherein a downstream portion of the first level casing is pre-expanded and a downstream end portion thereof is sealed;

Step II: putting a drilling tool into the downhole to pierce the first level casing and continue the drilling, wherein a side wall of the pierced first level casing forms an overlapping portion downstream thereof;

Step III: putting a second level casing and the expansion tool into the downhole, wherein a downstream end portion of the second level casing is sealably provided with cementing accessories and a downstream portion of the second level casing comprises a pre-expanded expansion promoter region, upstream of which is provided with an overlapping area, the upstream portion of which is disposed in the overlapping portion of the first level casing, the expansion tool being constructed that the fixing cone thereof is arranged in the expansion promoter region;

Step IV: carrying out well cementation and putting a drill shaft rubber plug into the downhole, wherein the drill shaft rubber plug engages with the rubber plug of the expansion tool so as to seal the downstream end portion of the central tube;

Step V: filling liquid in the downhole casing expansion tool, pressing so that the second level casing expands under the function of the expansion tool, and lifting the downhole casing expansion tool so that an outer diameter of the second level casing expands to be equal to an inner diameter of the first level casing and to enable the second level casing to fixedly connect to the first level casing;

Step VI: repeating Step II to Step V and connecting an upstream portion of the downstream casing to the overlapping area of the upstream casing so as to complete multilevel casing monohole expansion operations.

18. The method according to claim 17, wherein in Step III, the fixing cone of the expansion tool is constructed in such a way that an outer diameter thereof is smaller than an inner diameter of the expansion promoter region but larger than an inner diameter of the second level casing arranged upstream of the expansion promoter region.

19. The method according to claim 18, wherein in Step IV, removing an unexpanded portion in a downstream portion of the casing after the expansion of each level of casing is completed.

20. The method according to claim 19, wherein an outer side of the overlapping area of the second level casing is provided with a compressible filler for separating cement.

21. The method according to claim 20, wherein the filler is air.

22. The method according to claim 17, wherein a sealing member is further provided between the overlapped casings.

* * * * *